US006803569B2

(12) United States Patent
Tsybin et al.

(10) Patent No.: US 6,803,569 B2
(45) Date of Patent: Oct. 12, 2004

(54) METHOD AND DEVICE FOR IRRADIATING IONS IN AN ION CYCLOTRON RESONANCE TRAP WITH PHOTONS AND ELECTRONS

(75) Inventors: Youri O. Tsybin, Uppsala (SE); Gökhan Baykut, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 150 days.

(21) Appl. No.: 10/397,634

(22) Filed: Mar. 26, 2003

(65) Prior Publication Data

US 2003/0183760 A1 Oct. 2, 2003

(30) Foreign Application Priority Data

Mar. 27, 2002 (DE) ..... 102 13 652

(51) Int. Cl.[7] ..... H01J 49/16; H01J 49/38

(52) U.S. Cl. ..... 250/292; 250/290; 250/282; 250/281; 250/423 R; 250/424; 250/504 R

(58) Field of Search ..... 250/292, 290, 250/282, 281, 423 R, 424, 504 R

(56) References Cited

U.S. PATENT DOCUMENTS 4,924,089 A 5/1990 Caravatti
6,573,495 B2 * 6/2003 Senko ..... 250/290

FOREIGN PATENT DOCUMENTS

| | | | |
|---|---|---|---|
| EP | 1 347 486 | A1 | 9/2003 |
| GB | 854943 | A | 12/1958 |
| GB | 1 222 577 | A | 2/1971 |
| GB | 2 353 632 | A | 2/2001 |
| WO | WO 02/078048 | A1 | 10/2002 |

OTHER PUBLICATIONS

Marshall et al., "Fourier Transform Ion Cyclotron Resonance Mass Spectrometry: A Primer", Mass Spectrometry Reviews, vol. 17, John Wiley & Sons, Inc., 1998, pp 1–35.

McLafferty et al., "Electron Capture Dissociation of Gaseous Multiply Charged Ions by Fourier–Transform Ion Cyclotron Resonance", American Society for Mass Sepctrometry, vol. 12, Elsevier Science Inc., 2001, pp 245–247.

Tsybin et al., "Improved low–energy electron injection systems for high rate electron capture dissociation in Fourier transform ion cyclotron resonance mass spectrometry", Rapid Communications In Mass Spectrometry, vol. 15, John Wiley & Sons, Ltd., 2001, pp 1849–1854.

Hendrickson et al., "Electron beam potential depression as an ion trap in Fourier transform ion cyclotron resonance mass spectrometry", International Journal of Mass Spectrometry and Ion Processes, vol. 141, Elsevier Science B.V., 1995, pp 161–170.

Budnik et al., "Electron detachment dissociation of peptide di–anions: an electron–hole recombination phenomenon", Chemical Physics Letters, vol. 342, Elsevier Science B.V., Jul. 13, 2001, pp 299–302.

Hofstadler et al., "Infrared Multiphoton Dissociation in an External Ion Reservoir", American Chemical Society, vol. 71, No. 11, Analytical Chemistry, Jun. 1, 1999, pp 2067–2070.

Colorado et al., "Use of Infrared Multiphoton Photodissociation with SWIFT for Electrospray Ionization and Laser Desorption Applications in a Quadrupole Ion Trap Mass Spectrometer", American Chemical Society, vol. 68, No. 22, Analytical Chemistry, Nov. 15, 1996, pp 4033–4043.

(List continued on next page.)

*Primary Examiner*—Nikita Wells

(57) ABSTRACT

The present invention relates to a method and a device for irradiating ions in a ion cyclotron resonance (ICR) trap with photons and/or electrons. For electron irradiation a hollow electron emitter is used, through the hole of which a light beam can be sent into the ICR trap. The emitter generates a hollow, tubular electron beam. In a special application low energy ions within the tubular electron beam are irradiated with photons. The ions can be cyclotron-excited mass selectively, by which they enter the electron beam and interact with electrons.

21 Claims, 10 Drawing Sheets

OTHER PUBLICATIONS

Schweikhard et al., "Excitation Modes for Fourier Transform–Ion Cyclotron Resonance Mass Spectrometry", Account and Perspective vol. 4, American Society for Mass Spectrometry, 1993, pp 433–452.

Zubarev et al., "Electron Capture Dissociation for Structural Characterization of Multiply Charged Protein Cations", American Chemical Society, vol. 72, No. 3, Analytical Chemistry, Feb. 1, 2000, pp 563–573.

Little et al., "Infrared Multiphoton Dissociation of Large Multiply Charged Ions for Biomolecule Sequencing", American Chemical Society, vol. 66, No. 18, Analytical Chemistry, Sep. 15, 1994, pp 2809–2815.

Tsybin, Y. et al., "Large Emitting Area Electron Gun for Electron Capture Dissociation in Fourier Transform Ion Cyclotron Resonance Mass Spectrometry", The 49th ASMS Conference on Mass Spectrometry and Allied Topics, Chicago, USA, May 2001 (Power Point Presentation).

* cited by examiner

Figure 4a
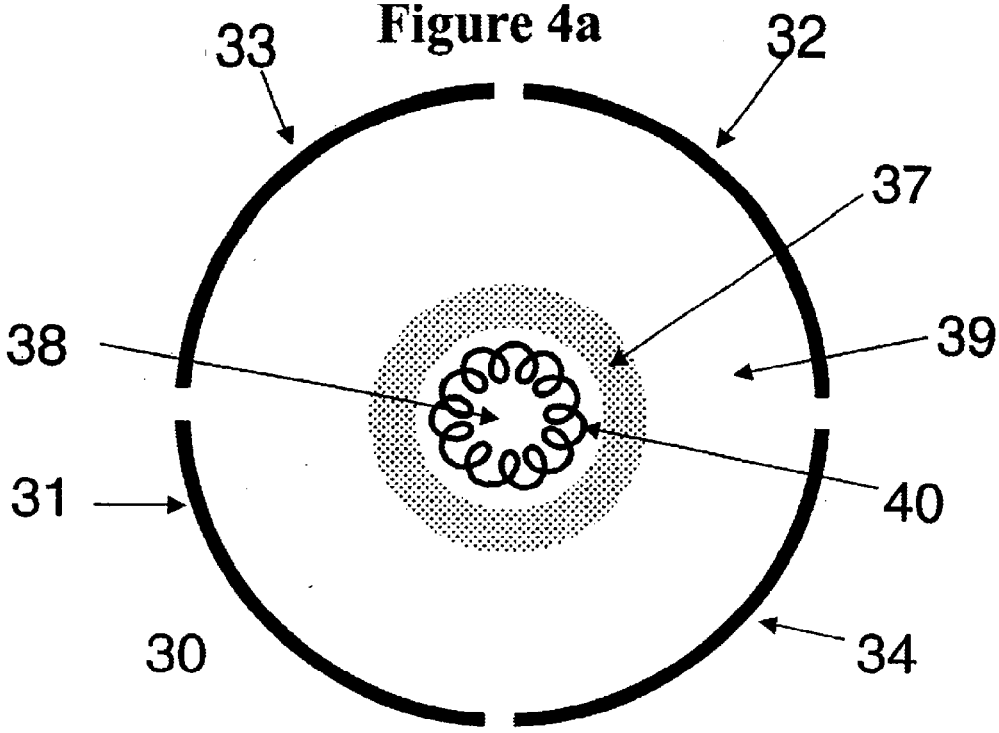
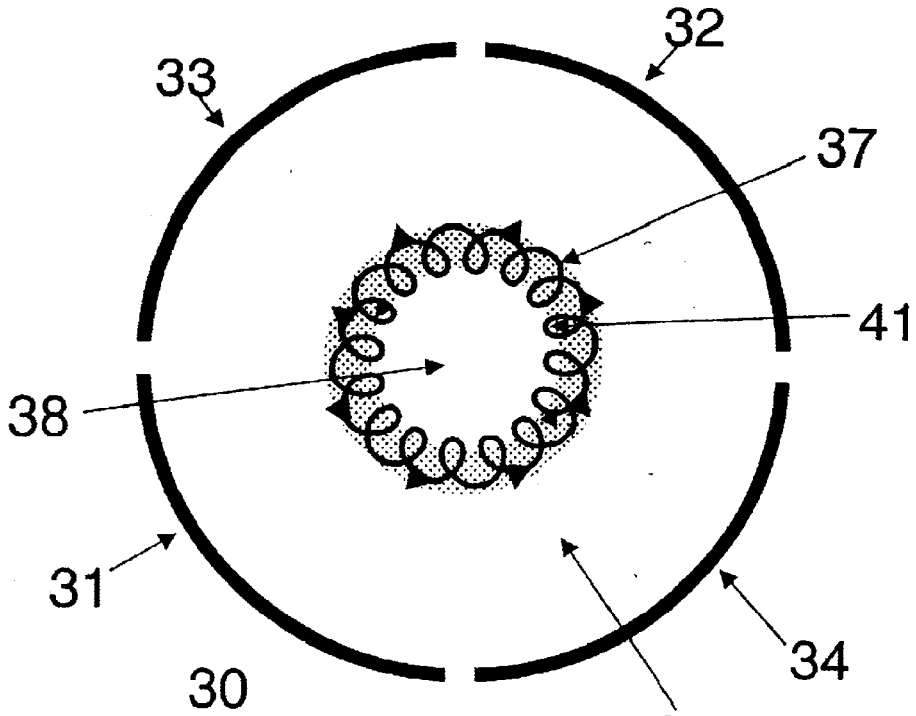
Figure 4b

Figure 8a
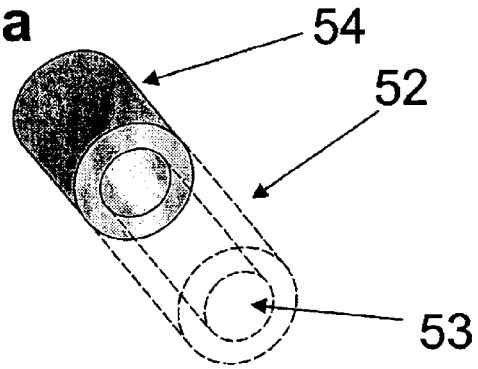
Figure 8b
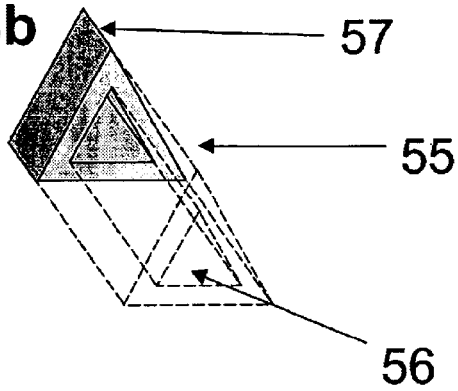
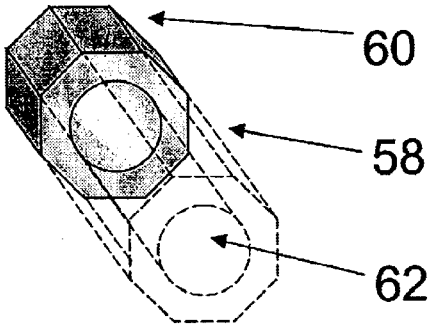
Figure 8c
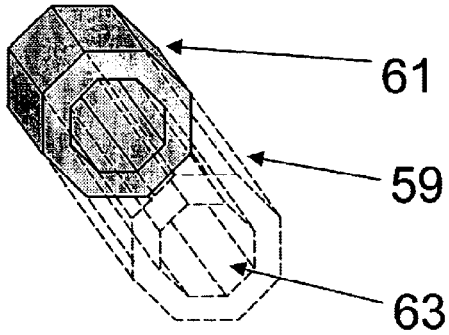
Figure 8d

METHOD AND DEVICE FOR IRRADIATING IONS IN AN ION CYCLOTRON RESONANCE TRAP WITH PHOTONS AND ELECTRONS

FIELD OF INVENTION

The invention relates generally to ion cyclotron resonance trap mass spectrometry and, more particularly, to the irradiation of ions in an ion cyclotron resonance trap.

BACKGROUND OF THE INVENTION

Due to its very high mass accuracy and mass resolution, Fourier-transform ion cyclotron resonance mass spectrometry (FT-ICR-MS) has a unique place in ion-trap mass spectrometry. FT-ICR-MS uses electromagnetic ion traps. In a magnetic field, all ions with a component of motion perpendicular to the magnetic field lines are forced by the Lorentz force to describe cyclotron orbits. Without absorbing additional energy, they are unable to escape in the plane perpendicular to the magnetic field. However, a motion of ions along the magnetic field lines does not cause a Lorentz force, thus, the ions must be trapped in this dimension with an additional electric field. The ion detection is made here by determination of cyclotron frequencies of ions based on image currents in the trap. Since those frequencies are inversely proportional to the m/z ratio (mass divided by the number of charges) of the circling ions, the frequency determination means the determination of the m/z ratio. Nowadays, in analytical FT-ICR-MS generally strong superconducting magnets are used. The FT-ICR mass spectrometry has been reviewed by Marshall, A. G.; Hendrickson, C. L.; Jackson, G. S. "Fourier Transform Ion Cyclotron Resonance Mass Spectrometry: A primer" *Mass Spectrom. Rev.* 1998, 17, 1–35.

Electron capture dissociation (ECD) is a relatively new method to fragment ions and to obtain insight into the ion structures using the information from fragment ion spectra. During the ECD process multiply charged ions in an ICR trap capture low energy electrons to produce cationic dissociation products. Multiply charged ions can be generated for example by electrospray ionization. The electron capture dissociation of peptide or protein ions mainly results in c and z type fragment ions. These c and z fragments, which are usually not formed in collision induced dissociation processes (CID, see below), are produced by cleaving the bond between the amino-nitrogen atom, which is involved in the peptide bond, and the neighboring carbon atom from which the amino group originates. The c and z fragments from ECD provide sets of information complementary to those from fragmentation by other ion-fragmentation methods and lead to a more complete determination of the sequences of polypeptides and proteins. The following literature is recommended about the fundamentals and applications of the ECD method: McLafferty, F. W.; Horn, D. M.; Breuker, K.; Ge, Y.; Lewis, M. A.; Cerda, B.; Zubarev, R. A.; Carpenter, B. K. "Electron Capture Dissociation of Gaseous Multiply Charged Ions by Fourier Transform Ion Cyclotron Resonance" *J. Am. Soc. Mass Spectrom.* 2001, 12, 245–249. Zubarev, R. A.; Horn, D. M.; Fridriksson, E. K.; Kelleher, N. L.; Kruger N. A.; Lewis, M. A.; Carpenter, B. K.; McLafferty, F. W. "Electron Capture Dissociation for Structural Characterization of Multiply Charged Protein Cations" *Anal. Chem.* 2000, 72, 563–573.

Dissociation processes resulting from electron-ion interactions are not limited to ECD. For characterization of negatively charged ions, the electron detachment dissociation (EDD) is used. In the EDD process, an electron is removed from multiply charged ions, while anionic dissociation products are formed (Budnik, B. A.; Haselman, K. F.; Zubarev, R. A. "Electron Detachment Dissociation of Peptide Di-Anions: An Electron-Hole Recombination Phenomenon" *Chem. Phys. Lett.* 2001, 342, 299–302).

The efficiency and rate of ECD is dependent on the electron flux density. The efficiency and rate of ECD can be improved by maximizing the overlap of ions with the electron beam. In conventional FT-ICR mass spectrometry, electrons are generated by a filament, which is placed outside the ICR trap. In most cases, the filament is in the vicinity of the trap and still in the room-temperature bore of the superconducting magnet. Electrons are guided parallel to the magnetic field (axially) into the trap. Due to reasons of thermal conductivity, only a central region of a filament reaches a suitably high temperature and emits electrons. Therefore, the electron beam is usually very thin like a thread in the magnetic field. After the electron beam is formed, attempts to expand this thin beam fail, since every movement perpendicular to the magnetic field produces a Lorenz force at right angles to it, which drives the electrons into tiny cyclotron trajectories. The electron beam must therefore be generated as a wider beam initially. Recently, large-surface electron emitters have been used to produce electrons for the ECD experiments. This way, the electron emitting area has been dramatically increased and the probability of ion-electron interactions in the ICR trap leading to dissociation is increased. In fact, by using these new emitters, improved ECD results have been obtained (Tsybin, Y. O.; Hakansson, P.; Budnik, B. A.; Haselmann, K. F.; Kjeldsen, F.; Gorshkov, M.; Zubarev, R. A.; "Improved Low Energy Electron Injection Systems for High Rate Electron Capture Dissociation in Fourier Transform Ion Cyclotron Resonance Mass Spectrometry" *Rapid Commun. Mass Spectrom.* 2001, 15, 1840–1854; as well as the world patent application WO 02/078048 A1 published in October 2002.).

In FT-ICR MS, one would like to study the interaction of stored ions with photons as well. It is possible to irradiate and excite ions with photons. As a result of this excitation ions can be fragmented too (photodissociation). The photons can be generated from ultraviolet, visible or infrared light, which may also be a laser beam.

A photo-induced fragmentation method which is increasingly used in FT-ICR mass spectrometry is infrared multiphoton dissociation (IRMPD). In this case, the ions are excited by multiple, sequentially absorbed infrared photons produced by an infrared laser (e.g. a $CO_2$ laser). Subsequently, a dissociation process is observed which produces similar results to the widely used collision induced dissociation (CID) method. For mass spectrometric methods such as FT-ICR, which require a very good ultra-high vacuum, IRMPD is a popular alternative since, in this case, no collision gas has to be "pulsed in" to fragment the ions. Similar to the CID, the so-called b- and y-type fragment ions from peptide or protein ions are also produced in IRMPD experiments. These ions are obtained by a cleavage of the bond between the peptide nitrogen atom and the (neighboring) carboxyl carbon atom. IRMPD is not only used in sequencing polypeptides and proteins, it is also generally used to investigate the higher order structures of biomolecules and their dynamics. When using the infrared laser to obtain a dissociation spectrum which will allow an identification of a substance, the irradiation time is generally less than 500 ms in FT-ICR mass spectrometry. In order to induce an infrared multiphoton dissociation, the IR laser beam must be introduced into a region where the ions are present. The interaction of ions with the laser beam can best be studied in an ion trap (Paul trap, Penning trap, ion cyclotron trap or linear RF multipole trap). For infrared multiphoton dissociation experiments in one of these traps, an infrared laser beam is introduced, usually axially to the trap and in most cases through the aperture of one of the end plates (end plates in the linear multipole trap, trapping plates in the FT-ICR trap or end caps in the Paul trap). Examples of literature which deals with the use of IRMPD applications are: Little, D. P.; Speir, J. P.; Senko, M. W.; O'Connor, P. B.; McLafferty, F. W. "Infrared Multiphoton Dissociation of Large Multiply-charged Ions for Biomolecule Sequencing" *Anal. Chem.* 1994, 66, 2809–2815; Colorado, A.; Shen, J. X.; Vartanian, V. H.; Brodbelt J. "Use of Infrared Multiphoton Photodissociation with SWIFT for Electrospray Ionization and Laser Desorption Applications in a Quadrupole Ion Trap Mass Spectrometer" *Anal Chem.* 1996, 68, 4033–4043; Hofstadler, S. A.; Sannes-Lowery, K. A.; Griffey R. A. "Infrared Multiphoton Dissociation in an External Ion Reservoir" *Anal. Chem.* 1000, 71, 2067–2070.

With the introduction of the new ECD fragmentation method, methods for introducing electrons into the ICR trap became especially popular. ECD experiments have to be carried out with low energy electrons. One of the axial entrances of the ICR trap is normally used for the introduction of ions (which are generated in an external ion source) into the trap. The other axial entrance is often used for infrared multiphoton dissociation experiments.

Since only shielded ICR magnets are used nowadays, the use of an external, non-axial electron source, of which the electrons would follow the magnetic field lines to enter the ICR trap, is complicated. With shielded superconducting magnets, the magnetic field shows (axially) a dramatic gradient only in the immediate vicinity of the geometric limits of the magnet housing. In order to achieve efficient electron injection into the ICR trap, the electron source is positioned in a region where there is a high (and uniform) magnetic field. At locations where a non-axial electron source is usually placed outside the magnet, the fringing fields of a shielded magnet is not strong enough. Since the external ion sources (external to the ion trap) are constantly used in FT-ICR mass spectrometry and IRMPD is very often used (laser beam enters from the other side of the ICR trap), it is almost impossible to additionally install an electron source axial to the trap.

FIG. 1 (prior art) shows a Fourier transform ion cyclotron resonance mass spectrometer with an external ion source (1). The ion source (1) in the figure is only shown schematically. Ions (2) which are generated in this source are transferred to the ICR trap (4) using a special ion transfer lens system (3). The figure shows a cylindrical ICR trap as an example. The ion beam (5) is guided into the ion trap axially from the source end through the aperture (6) in the trapping plate (7) on the left. The ICR trap is located in a magnetic field (aligned, for example, in the direction of the arrow 8) co-axially to the field produced by a superconducting magnet (9). Nowadays, magnetic fields of magnetic inductions from 3 to 12 Tesla are used in commercial FT-ICR systems. Ions are captured and stored in the ICR trap and excited and detected later on.

A typical experiment using stored ions is the infrared multiphoton dissociation experiment. An infrared laser (for example a $CO_2$ laser) (10), mounted behind the magnet, projects its beam into the ICR trap through a laser window (11) and through the aperture of the trapping plate on the right (12). In this specific set up, the laser beam (13) is deflected by a mirror (14) by 90°. Ions in the ICR trap get excited by sequentially absorbing a number of the IR photons, and dissociate.

The formation of the fragment ions generated by the infrared multiphoton dissociation (IRMPD) is closely correlated to the structure of the initial ion and its chemical bonding conditions. This method is therefore used in mass spectrometry for ion structure determination. Some details shown in the figure are the vacuum stage partitions (15) and (16) and the three pump nozzles (17), (18) and (19). This figure clearly shows that the two axial introductions into the ion cyclotron resonance trap are occupied. The ions generated outside the trap are introduced into the trap on one side and the infrared laser beam is introduced on the other side. Since one side (left side in FIG. 1) is almost always occupied with the ion introduction, the other side (right side in FIG. 1) has to be used for introducing beams or particles. According to the prior art, a constant switching between the laser window and electron sources, etc., is necessary. This process requires a venting of the ultrahigh vacuum. Therefore, the prior art excludes the simultaneous application of experimental methods that require the introduction of photons as well as electrons into the ICR trap. Neither does the prior art allow sequential use of these techniques on the very same batch (ensemble) of stored ions (in the ICR trap).

The use of sliding and rotating feedthroughs for moving the ion and electron sources solves the problem to a very limited extent, as these methods are generally awkward and slow. In the ultra-high vacuum system used in Fourier transform mass spectrometry in the range of $10^{-10}$ mbar, placing a sliding or rotating feedthrough with the corresponding vacuum locks is an option that requires intensive work.

For experiments which require simultaneous irradiation of ions with photons and low energy electrons, these slow and time consuming methods of switching from electron beam to photon beam (and back) are basically useless. Sequential ECD and IRMPD experiments for kinetic analysis of the assembly of ions stored in the ICR trap require faster switching methods. Recently, studies of protein ions in the ICR trap using ECD and IRMPD have indicated that protein ions undergo rapid structural changes (e.g. folding and unfolding) (Hom, D. M.; Breuker, K.; Frank, A. J.; McLafferty, F. W. "Kinetic Intermediates in the Folding of Gaseous Protein Ions Characterized by Electron Capture Dissociation Mass Spectrometry" *J. Am. Chem. Soc.* 2001, 123, 9792–9799).

Since electron capture dissociation provides important complementary results for infrared multiphoton dissociation, it is advantageous for users of FT-ICR mass spectrometers to apply ECD and IRMPD on the test substances simultaneously. Thus, it is important to be able to switch between the fragmentation methods without time consuming mechanical operations. It is also desirable to be able to use ECD and IRMPD on the same group of ions, if possible, in the same experimental sequence. However, since filaments or larger cathodes (such as dispenser cathodes or other indirectly heated cathodes) are used for electron capture dissociation, these block the path into the ICR trap and, for example, a laser beam can no longer be introduced at the same time.

SUMMARY OF THE INVENTION

The idea of the invention is to be able to use a hollow (or tubular) electron beam and light beams simultaneously. The tubular electron beam is provided by an electron injection system that contains a hollow electron emitter which has a bore in it. The electron injection system therefore enables the passage of light beams parallel to the magnetic field in which the ICR trap is located. The light beams (also laser light) can be in the ultraviolet (UV), visible (VIS) or infrared (IR) range.

A ring shaped (hollow cylindrical) electron emitter (hollow cathode, ring cathode) placed at one end of the ICR trap produces an annular electron cloud which can be extracted along the magnetic field lines in the direction of the ICR trap. By continuous or pulsed extraction of this electron cloud, a hollow tubular electron beam is produced. It is also possible to control the flux of the electrons in the tubular electron beam by using suitable devices, such as grids, apertured diaphragms and ring shaped electrodes. This way, multiply charged ions can dissociate in the ICR trap by capturing low energy electrons (electron capture dissociation). Low energy electrons are defined as electrons with kinetic energies $E_k \leqq 30$ eV and, in particular, $E_k \leqq 1$ eV.

An infrared laser beam (usually non-focused and about 2 mm wide) which enters the ICR trap is needed for the IRMPD experiments in the ICR trap. Since the present invention uses a hollow electron emitter (hollow cathode, ring cathode) for generating electrons, the aperture in the emitter enables the infrared beam to be introduced even while the hollow cathode is in operation. This combination makes it possible to operate the electron emitter alone in order to study electron-ion interactions (such as electron capture dissociation) or to switch on the light beam and study ion-photon interactions (such as the photodissociation of ions). This invention also allows simultaneous irradiation with electrons and photons. Of course, it is possible to ionize neutral molecules in the ICR trap both with electrons and with photons.

Positive ions which are located in the ICR cell can be further ionized by interacting with an electron beam—in a similar way to electron-impact ionization—where a change in the charge number happens. For this purpose, however, electrons with a higher kinetic energy are necessary.

A further use for the invention is electron detachment dissociation (EDD) of multiply negatively charged ions in the ICR trap. In this case, the interaction of the ion of interest with an electron leads to the detachment of an electron and dissociation of the ion.

BRIEF DESCRIPTION OF THE DRAWINGS

In FIG. 2*a*, the electron emitter is in operation while in FIG. 2*b* the emitter is inactive. A laser beam is introduced through the bore of the hollow cathode. In FIG. 2*c*, both the emitter and the laser are in operation.

FIGS. 4*a* and 4*b* show magnetron excitation of an ion in the ICR trap from a lower (FIG. 4*a*) to a higher (FIG. 4*b*) magnetron orbit in order to let this ion interact with the hollow electron beam.

FIGS. 8*a*–8*d* show different shaped hollow cathodes generating tubular electron beams of different cross sections.

DETAILED DESCRIPTION

Figure 1:
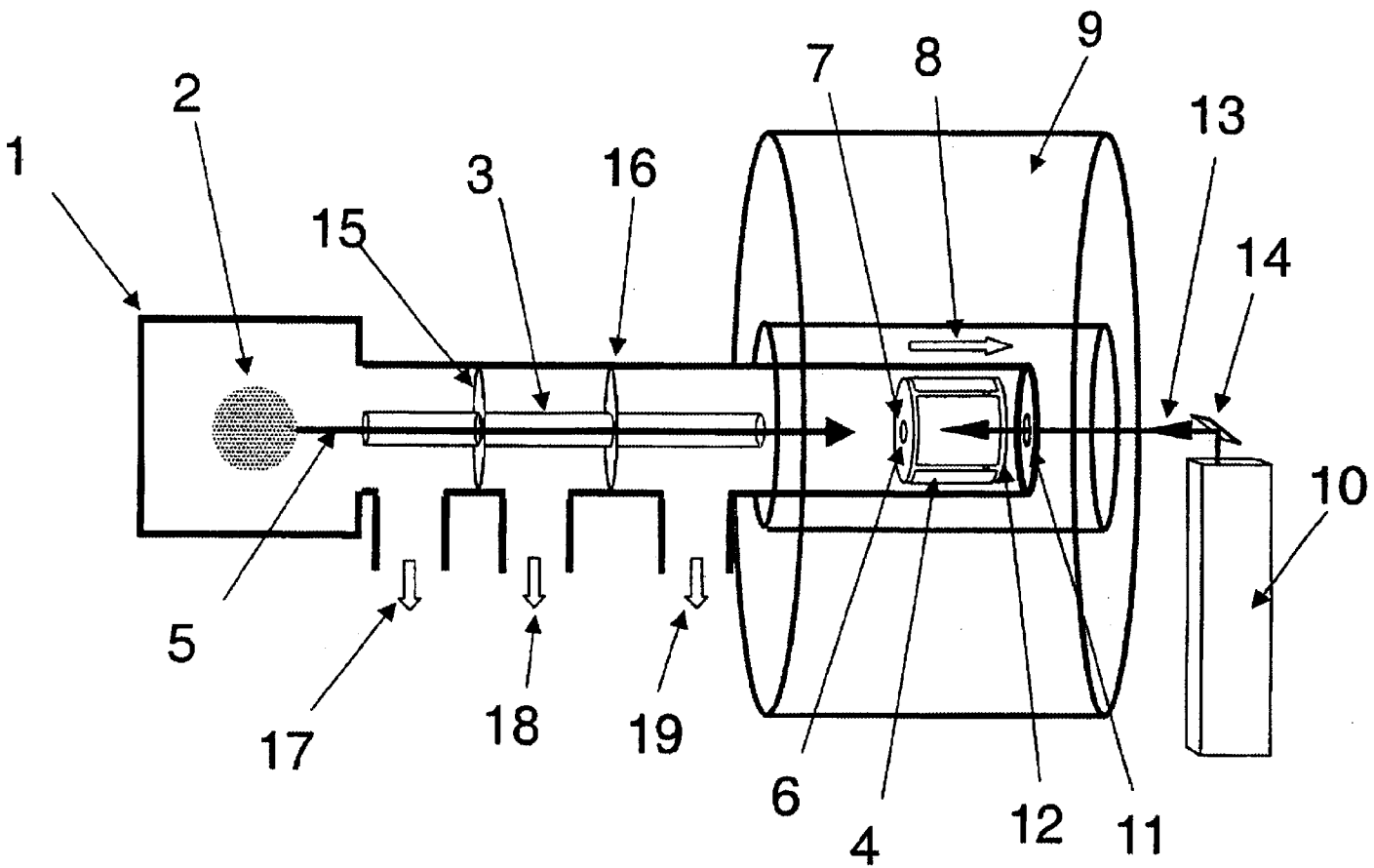
FIG. 1 shows a Fourier transform ion cyclotron resonance mass spectrometer with an external ion source.
Figure 2A:
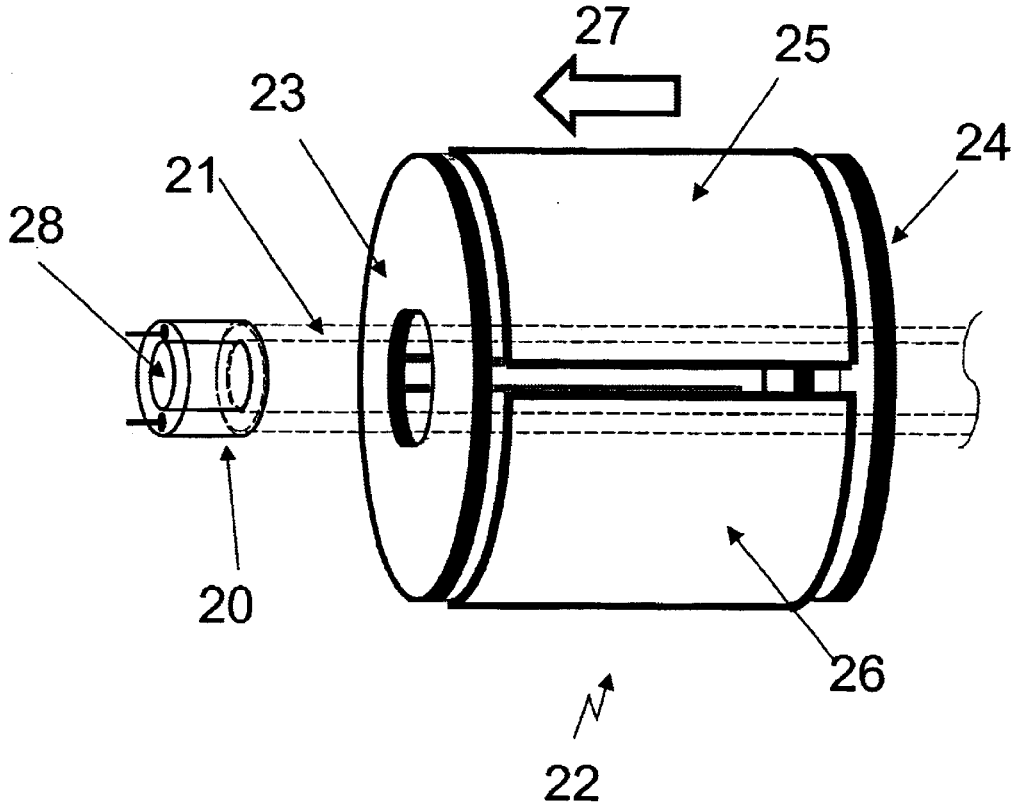
FIGS. 2*a*–2*c* show an electron emitter in form of a hollow cylinder. This emitter is placed in front of an ICR trap.
Figure 2B:
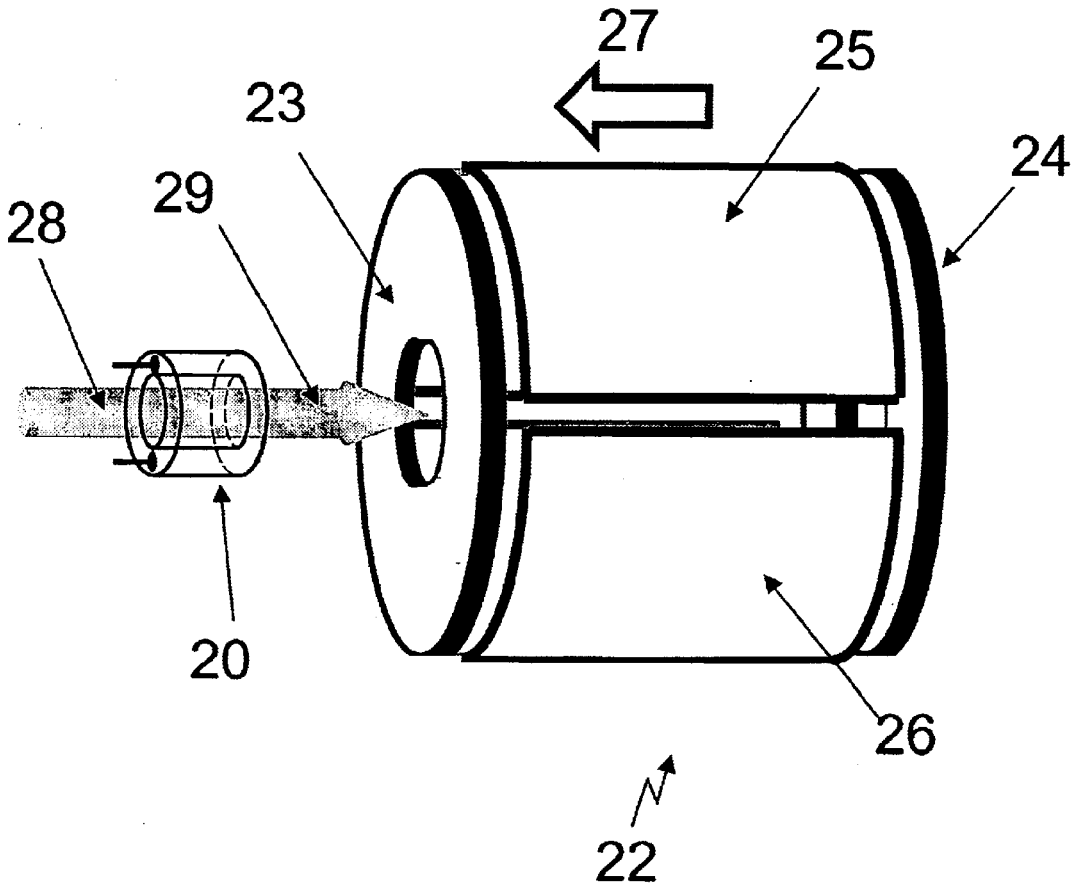
Figure 2C:
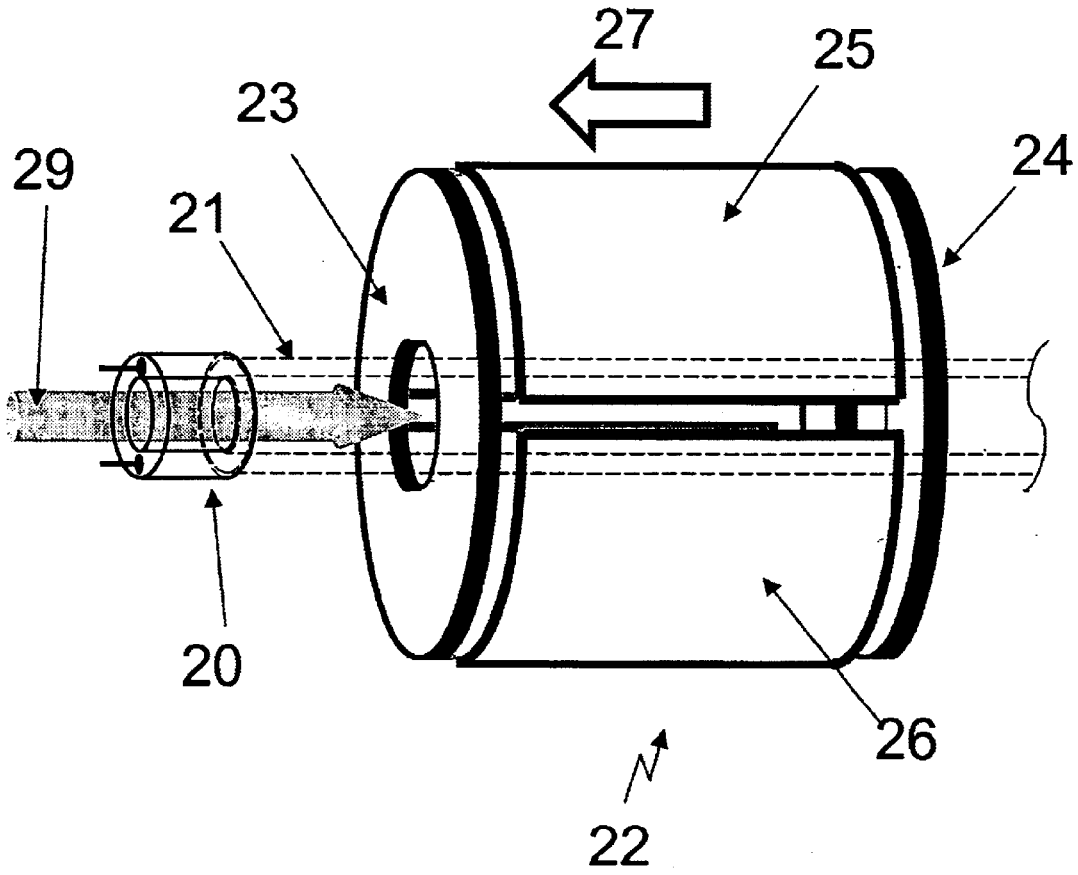

FIGS. 2*a*–2*c* show an emitter in form of a hollow cathode (20) which is used in the present invention as the electron source in FT-ICR mass spectrometry. The emitter produces a tubular electron beam (21) which passes along the trap axis inside the cylindrical ICR trap. Trapping plates (23) and (24) of the ICR trap hold the ions in the axial direction in the trap. Also shown are one of the excitation plates (25) and one of the detection plates (26) of the ICR trap. The ICR trap is placed coaxial to the direction of the magnetic field. The direction of the magnetic field is indicated by the arrow (27). The aperture (28) of the hollow cathode (20) allows the introduction of photons, e.g., of a laser beam. During the experiments in FIG. 2*a*, ions are brought to interaction with electrons in the ICR trap. Electrons generated at the hollow cathode are extracted and form an internally hollow, (tubular) electron beam which runs along the trap axis into the ICR trap. By letting the low energy electrons interact with the multiply charged ions stored in the ICR trap, ECD experiments can be performed. During the use of the hollow electron emitter, the aperture (28) is always open for the introduction of photons. FIG. 2*b* shows the introduction of a laser beam into the ICR trap. Unlike the prior art, the laser beam (29) in this case can be introduced into the ICR trap even though the electron emitter is mounted in its operating position. FIG. 2*c* shows the case where both the laser beam and the electron beam are switched on and the interaction of the same group of stored ions can be studied.

One characteristic of the invention is that the electron irradiation does not hit those ions which are circling in the center of the ICR trap at smaller orbits than the inner diameter of the hollow cathode. In order to study an ion-electron interaction, the low energy ions in the center of the trap must be brought to larger rotation orbits, for example either by a cyclotron excitation or by a magnetron excitation. Both a cyclotron and a magnetron excitation of the ions can be achieved by resonance absorption from an RF field. If ions enter the tubular electron beam by this way (FIG. 3*a*), they can interact with the electrons (FIG. 3*b*). The energy to be applied or the period of excitation with a specified RF amplitude can be calculated from the final radius of the excited cyclotron orbits—of course in dependence of the magnetic field (of the induction B) and the mass m of the ions. The initial kinetic energy of the ions should be called $E_0$. By a resonance absorption of the energy $qE_{RF}$ from the oscillating RF field $E_{RF}$, the radius $r_c$ of the cyclotron motion of the ion is excited to an average radius $\overline{r_H}$ of the hollow cathode:

$$mv^2/r_c = qvB \text{ or } r_C = mv/(qB)$$

$$\text{with } v = \sqrt{[2(E_0 + qE_{RF})/m]}$$

$$r_C = \overline{r_H} = \sqrt{[2m(E_0 + qE_{RF})]}/(qB)$$

and if the ions have thermal energies before the start of excitation, the initial kinetic energy $E_0$ will be equal to the thermal energy kT:

$$r_C = \overline{r_H} = \sqrt{[2m(kT + qE_{RF})]}/(qB)$$

with $\overline{r_H}$ as the average radius of the hollow cathode, where k is the Boltzmann constant, T the absolute temperature, $E_{RF}$ the electrical RF field and v the velocity of the ions (perpendicular to the magnetic field). However, it should be noted that the average radius of the hollow cathode is normally much larger than the thermal cyclotron radius $r_{C,kT}=\sqrt{[2mkT]/(qB)}$ if an unfocused laser light is also required to pass through the hollow cathode. In a magnetic field of induction B=7 Tesla, a thermal ion of mass 1000 u with a single charge has a cyclotron radius of approximately 100 $\mu$m.

When using the cyclotron excitation method, it is possible, for example, to excite a type of ions of mass m by exposing it to an irradiation at a fixed frequency of $\omega=qB/m$. Similarly, a group of ions with masses in the mass range of $m_1$ to $m_2$ can be excited by a rapid frequency scan of cyclotron frequencies ranging from $\omega_1=qB/m_1$ to $\omega_2=qB/m_2$.

The infrared laser beam arrives axially in the center of the ICR trap and interacts with the low energy ions in this region. These ions can then be excited to higher cyclotron radii, enter the interaction area with the electrons, and can get fragmented by ECD.

Figure 3A:
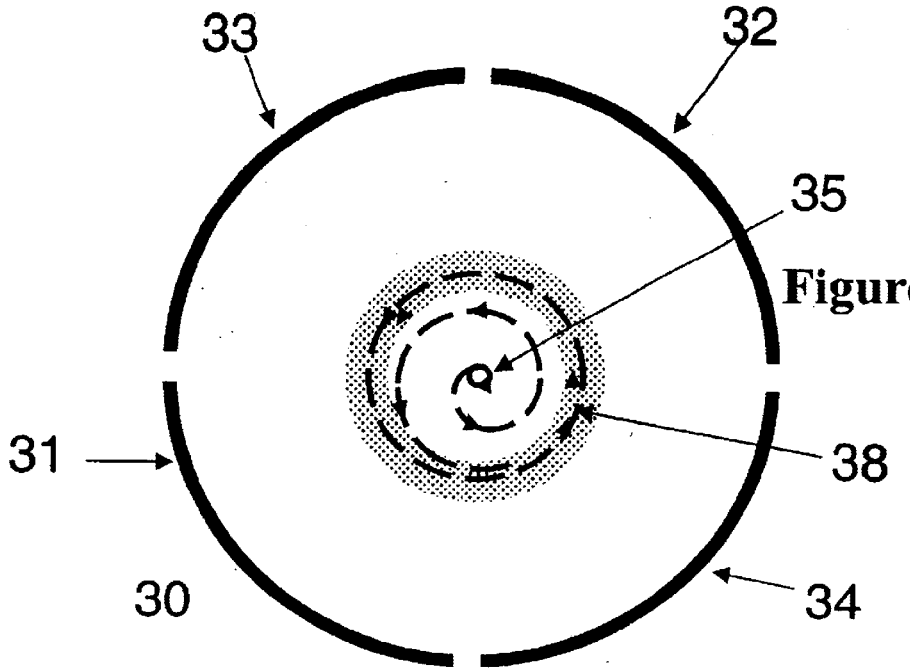
FIGS. 3*a* and 3*b* show the cyclotron excitation of ions, which initially circle at low energy near the axis of the trap (FIG. 3*a*). Upon excitation they enter a region where they can interact with the electrons (FIG. 3*b*).
Figure 3B:
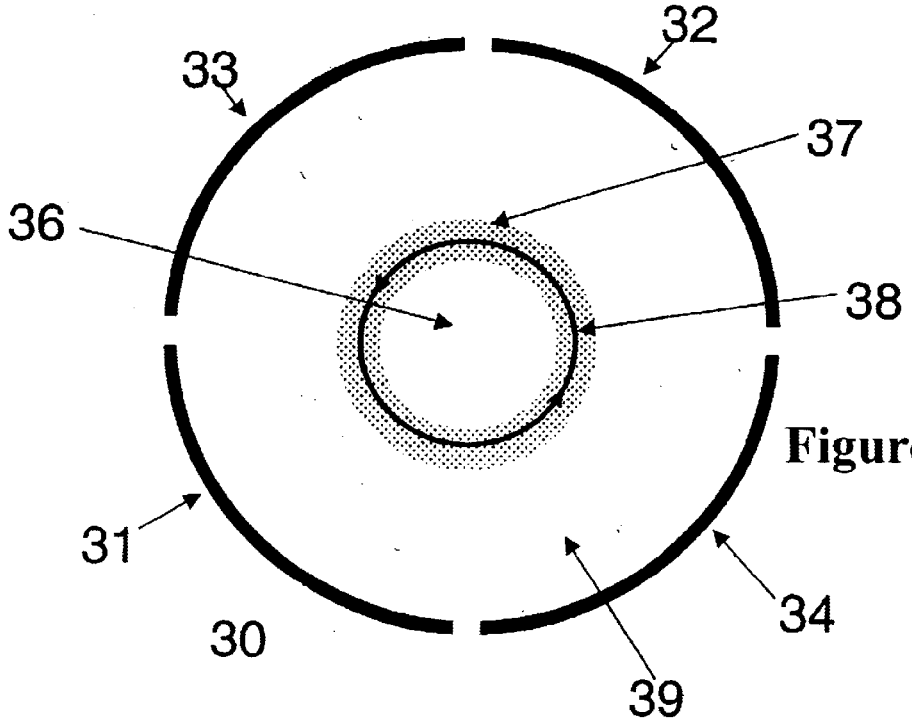

FIGS. 3*a* and 3*b* shows the cross section of an ICR trap (30). (31) and (32) are the excitation plates and (33) and (34) are the detection plates. Ions in the trap which initially circle (35) in the bore (36) of the hollow electron beam (37) are excited by cyclotron resonance excitation to larger radii (38) (FIG. 3*a*). When excited (FIG. 3*b*), the ions interact in the presence of the tubular electron beam (37) with these electrons and experiments, such as electron capture dissociation, can then take place. Ions which are initially outside the tubular electron beam (37) in region (39) are attracted by the electron beam.

FIGS. 4*a* and 4*b* shows the cross section of an ICR trap where the magnetron radii increase when the ions resonantly absorb the irradiated magnetron frequency. The epicycloidal orbits (40) and (41) actually show the cyclotron movement "wound up" onto a magnetron trajectory. The magnetron trajectory (40) in FIG. 4*a* has a small radius and still remains within the bore of the electron beam. In FIG. 4*b*, this trajectory is excited (41) and overlaps with the electron beam (37).

The experiments can, of course, also take place in the reversed order. The ions can first be excited to the ion-electron interaction radius. After electron capture, the kinetic energy of the ions can be reduced by collisions with inert gas molecules. Although the cyclotron radii of the ions are reduced by collisions, they may not necessarily come to the center of the cell. The ions can only be moved to the axis using quadrupolar excitation axialization (Schweikhard, L.; Marshall, A. G. "Excitation Modes for Fourier Transform-Ion Cyclotron Resonance Mass Spectrometry" *J. Am. Soc. Mass Spectrom.* 1993, 4, 433–452). During quadrupolar excitation axialization, the magnetron and cyclotron motions of the ions in the ICR trap are in dynamic equilibrium. The motions are periodically converted from one to the other. By pulsing in a collision gas, the ions can then be cooled. This brings them to the central axis of the ICR trap. By using "quadrupolar excitation axialization" technique such as this, it is possible to move the ions to the center of the ICR trap, where they can interact, for example, with photons from a laser beam.

In the present invention, the good overlap of the tubular electron beam with the trajectories of the circling ions enables the ECD technique to achieve a higher rate also in time-limited experiments. This way, ECD is carried out at the same time scale as the IRMPD technique. The techniques of photon and electron induced dissociation can then be combined with high pressure liquid chromatography (HPLC). In HPLC/FT-ICR mass spectrometry (electrospray interface), it is important to have as many mass spectrometric sampling points as possible from a few-seconds-wide chromatographic peak.

Unlike a potential depression produced by an electron beam (Tsybin, Y. O.; Hakansson, P.; Budnik, B. A.; Haselmann, K. F.; Kjeldsen, F.; Gorshkov, M.; Zubarev, R. A.; "Improved Low Energy Electron Injection Systems for High Rate Electron Capture Dissociation in Fourier Transform Ion Cyclotron Resonance Mass Spectrometry" *Rapid Commun. Mass Spectrom.* 2001, 15, 1840–1854 and Hendrickson, C. L.; Hadjarab, F.; Laude, Jr., D. A. *Int. J. Mass Spectrom. Ion Proc.* 1995, 141, 161–170), which leads to ion trapping, the potential distribution of the hollow electron beam in this invention is different. When the low energy ions are located in the central region of the ICR trap (Region 36 in FIGS. 3*b* and 4*b*), they are in the bore of the tubular electron beam. Inside the bore of the tubular electron beam no significant ion capture takes place, as the zone inside the bore of the electron beam is nearly field free. Ions circling on orbits of larger diameters than the outer diameter of the hollow electron beam can be more effectively captured by the potential depression of the electron beam.

Figure 5:
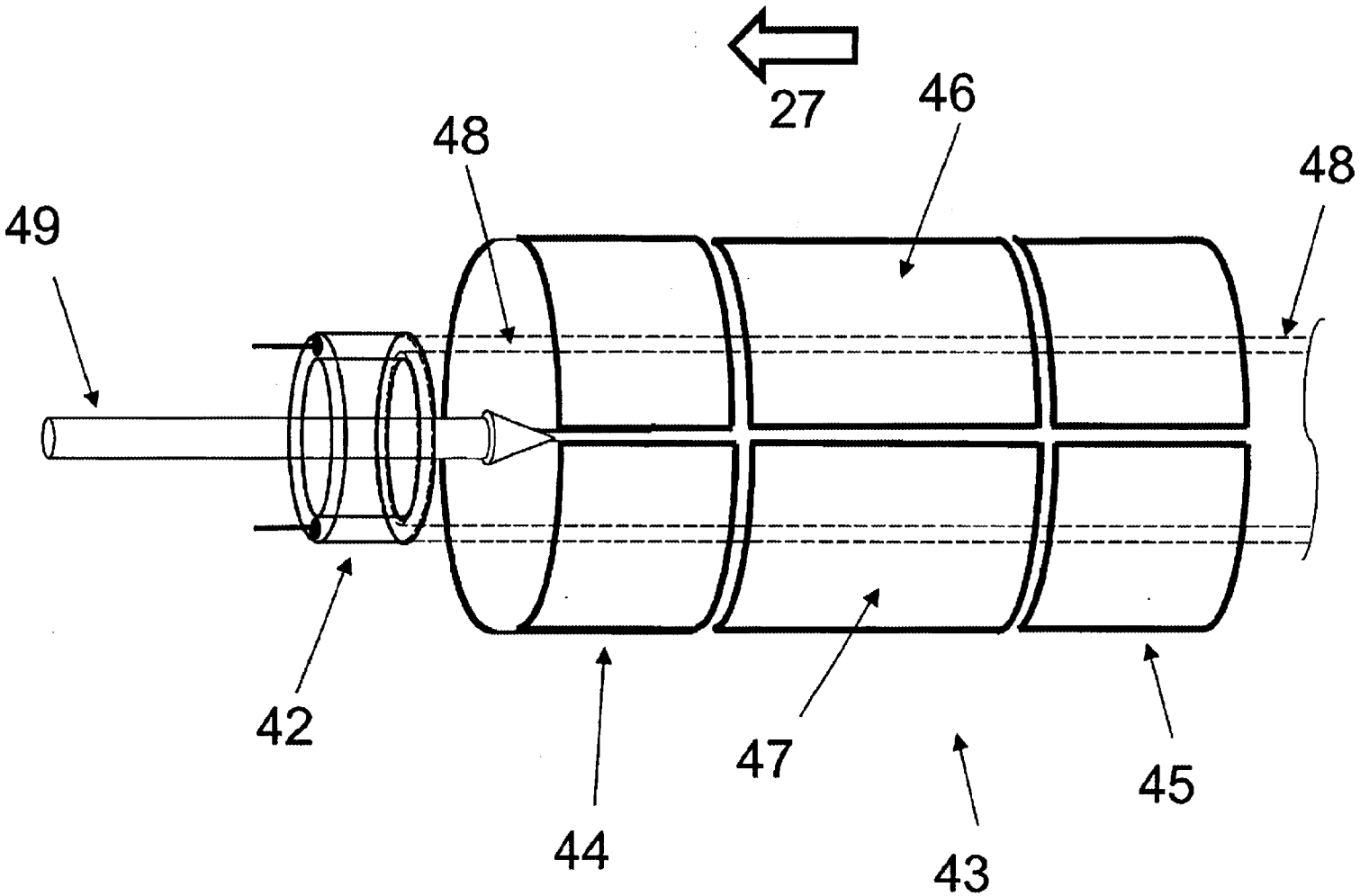
FIG. 5 shows a hollow electron emitter in front of an open cylindrical ICR trap with cylindrical hollow trapping plates at both ends.

In FIG. 5, a larger version of the ring cathode (hollow cylindrical cathode, 42) is in operation in front of an "open" ICR trap (43). Open ICR traps are also described in the review by Marshall, Hendrickson and Jackson mentioned on Page 1. Open ICR traps have no end plates (trapping plates) perpendicular to the magnetic field. The electrostatic trapping function of the flat end plates is performed by the cylindrical (hollow) trapping electrodes. In FIG. 5, (44) and (45) are the two split cylindrical trapping electrodes of the ICR trap. (46) and (47) are an excitation plate and a detection plate respectively. A tubular electron beam (48) is produced when the ring cathode is in operation. Photons can be sent at any time through the ring cathode and through the tubular electron beam into the ICR trap.

Figure 6:
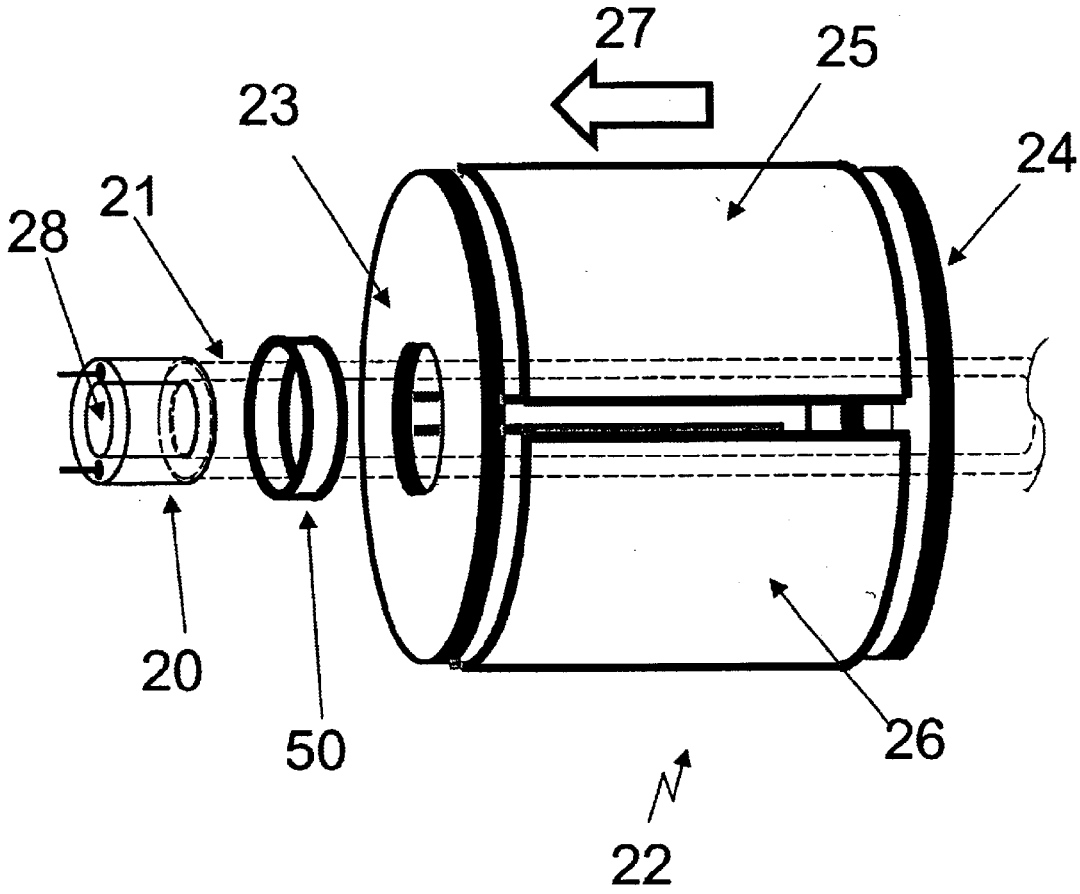
FIG. 6 shows an electron emitter in form of a hollow cylinder in front of an ICR trap. A ring is placed between the emitter and the ICR trap to extract the electrons and control their kinetic energies. The laser beam, not shown in the figure, of course, passes through the aperture of the ring.

FIG. 6 shows an electron emitter (20) in the form of a hollow cylinder in front of an ICR trap (22). Between the emitter (20) and the ICR trap (22) a potential control ring (50) is placed which is used to extract the electrons and to control the flux of electrons of the tubular electron beam. This electrode, which is shown as a ring (50) in FIG. 6, can also, of course, be in the form of an apertured diaphragm or a grid. The laser beam is not shown in FIG. 6 but, of course, also passes through the aperture of this electrode.

Figure 7:
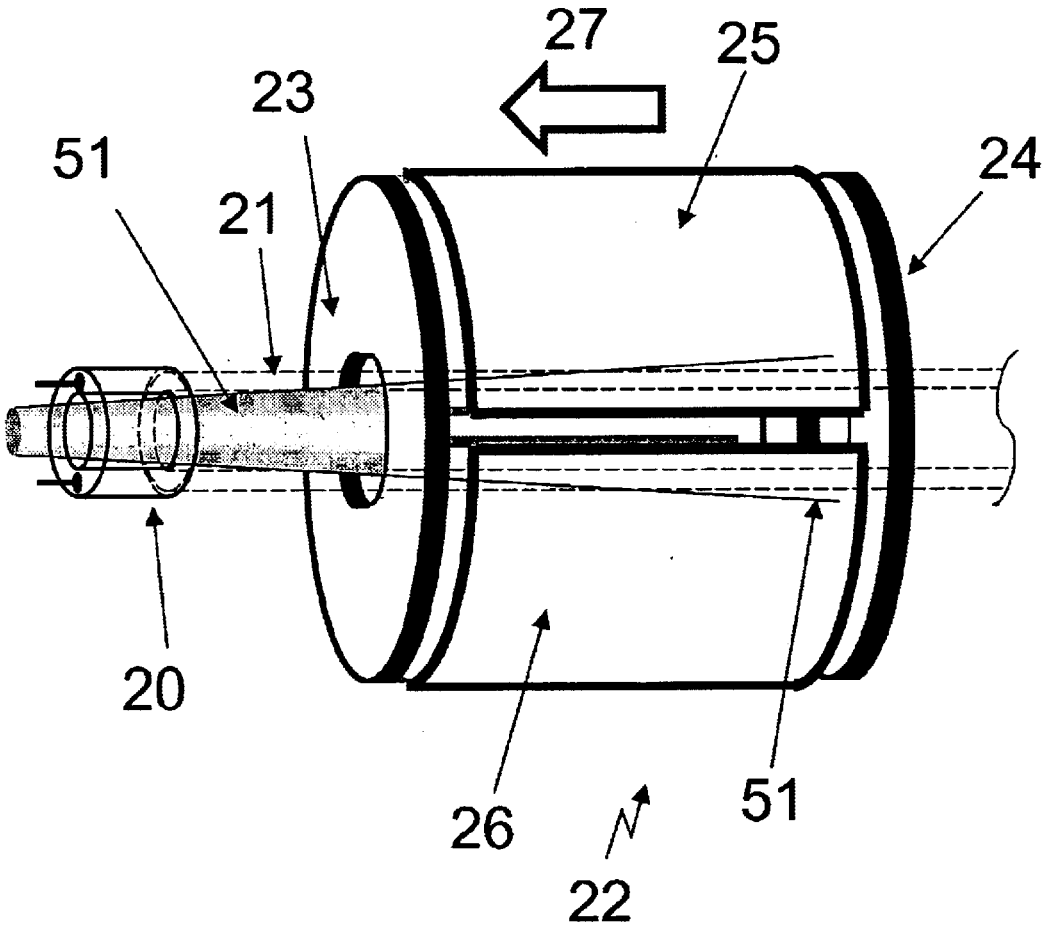
FIG. 7 shows the use of a divergent laser beam in an ICR trap in order to facilitate an overlap of photons and electrons in the tubular electron beam.

FIG. 7 shows the use of a divergent laser beam (51) in order to produce an overlap of the photons and electrons in the tubular electron beam (21) in the ICR trap (22). A divergence of the laser beam can be produced, e.g., by a concave lens. Ions which are initially in the vicinity of the trap axis and interact with the laser beam can then be excited to larger rotation orbits in order to interact with the electrons. The ions are here still in the field of the divergent laser beam and therefore still interact simultaneously with the photons.

Tubular electron beams of various cross sections can be produced by different shaped hollow cathodes. In strong magnetic fields thermal or low-energy electrons basically conserve their flight paths. At, e.g., B=7T, thermal electrons with any motion component orthogonal to magnetic field are forced to cyclotron motions of sub-micrometric radii: The electron beam cannot easily be diverted or distorted or focused, therefore, its cross section has the same shape as the emitting surface of the hollow cathode. The electron beam can be a cylindrical tubular beam, it can also be in the form of a hollow rectangular prism or hollow triangular prism. Basically, a tubular electron beam in form of any hollow polygonal prism can be generated. FIGS. 8*a*–8*d* schematically show some different shapes tubular electron beams. Cathodes generating the hollow electron beam are depicted in dark gray in the drawing, while the tubular electron beams are shown in dotted lines. FIG. 8(*a*) shows a cylindrical tubular electron beam (52) with a cylindrical bore (53) generated by a hollow cylindrical cathode (54). FIG. 8(*b*) shows a tubular electron beam of triangular cross section (55) with a triangular prismatic channel (56). The beam is generated at the hollow triangular cathode (57). FIGS. 8(*c*) and 8(*d*) show tubular electron beams in form of octagonal prisms (58) and (59), generated by hollow octagonal cathodes (60) and (61), respectively. The bore of the hollow cathode (60) has a circular cross section, the channel of the hollow cathode (61) has an octagonal cross section. Thus the tubular electron beam (58) of the cathode (60) has a cylindrical bore (62), and the electron beam of the cathode (61) has an octagonal prismatic channel (63).

What is claimed is:

1. Method for irradiating ions with electrons and/or photons in an ion cyclotron resonance trap inside a magnetic field, wherein a hollow electron emitter is used which is aligned parallel to the magnetic field and generates a tubular electron beam.

2. Method according to claim 1, wherein the electron emitter has the form of a hollow cylinder which is aligned parallel to the magnetic field and produces a tubular electron beam parallel to the magnetic field.

3. Method according to claim 1, wherein the electron emitter, which is aligned parallel to the magnetic field, has the form of a hollow polygonal prism with a cylindrical or polygonal prismatic channel, and produces a tubular electron beam parallel to the magnetic field.

4. Method according to claim 1, wherein the electron emitter produces low energy electrons to which the ions in the ion cyclotron resonance trap are exposed so that they dissociate by electron capture.

5. Method according to claim 1, wherein a certain group of low energy ions, which initially circle on very small orbits near the axis of the ion cyclotron resonance trap, are excited to larger orbits, interact with the electrons of the tubular electron beam and dissociate by capturing low energy electrons.

6. Method according to claim 5, wherein the ions are brought to larger cyclotron orbits by mass-selective cyclotron resonance excitation.

7. Method according to claim 5, wherein the ions of a mass range are excited to larger orbits by cyclotron resonance excitation with a frequency scan.

8. Method according to claim 5, wherein the ions undergo resonance excitation upon irradiation with the magnetron frequency and are brought to larger magnetron orbits.

9. Method according to claim 1, wherein a laser emitting infrared, visible or ultraviolet wave-lengths, or a laser with variable wavelength is used to irradiate the ions with photons.

10. Method according to claim 9, wherein by irradiation of stored ions with the infrared laser an infrared multiphoton dissociation of these ions takes place.

11. Method according to claim 1, wherein the ICR trap is radiated with photons and electrons simultaneously.

12. Method according to claim 1, wherein by sequential irradiation of the stored ions with low energy electrons and infrared laser beams an electron capture dissociation and an infrared multiphoton dissociation of these ions take place.

13. Method according to claim 12, wherein a selectively excited group of ions is exposed to the low energy electrons in the tubular electron beam, is compressed onto the axis of the ion cyclotron resonance trap by quadrupole excitation axialization in presence of pulsed collision gas, and is exposed to the laser beam.

14. Method according to claim 1, wherein selected groups of low energy ions, which initially circle close to the axis of the ICR trap, are excited to larger orbits and exposed to the low energy electrons of the tubular electron beam, while other ion groups near the trap axis are exposed to the laser beam.

15. Method according to claim 1, wherein the stored ions are exposed to two different laser beams, which enter the ICR trap through the hollow emitter, where the first beam is only used for selective excitation, subsequently the ions are also exposed to the electrons from the hollow electron emitter in order to initiate an ion dissociation process for analytical information.

16. Method according to claim 1, wherein the ions which are stored in the ICR trap are further ionized by the electrons from the hollow emitter.

17. Method according to claim 1, wherein multiply charged negative ions in the ICR trap are exposed to the tubular electron beam of the hollow cathode which results in electron detachment dissociation.

18. Method according to claim 1, wherein a divergent light beam is used which passes through the hollow electron emitter into the ICR trap, where it overlaps with the tubular electron beam.

19. Mass spectrometry apparatus comprising:

(a) an ion source capable of generating singly and multiply charged ions, (b) an ion cyclotron resonance trap placed in a magnetic field in a vacuum system, (c) means for exciting and detecting the ions in the ion cyclotron resonance trap and providing signals indicative thereof, (d) a hollow electron emitter system generating a tubular electron beam to irradiate ions in the ion cyclotron resonance trap with electrons.

20. Apparatus according to claim 19, equipped with an ultraviolet, visible or infrared light source, of which the light beam is directed through the bore of the hollow electron emitter into the ion cyclotron resonance trap in order to irradiate the ions.

21. Apparatus according to claim 20, wherein the light source is a laser emitting infrared, visible or ultraviolet wavelengths, or a laser with variable wavelength.

* * * * *